US008182173B2

(12) United States Patent
Lickel

(10) Patent No.: US 8,182,173 B2
(45) Date of Patent: May 22, 2012

(54) PORTABLE VIBRATORY CONCRETE WET SCREED WITH REMOTE GRADE INDICATOR AND FOLDING HANDLES

(75) Inventor: Timothy J. Lickel, Oconomowoc, WI (US)

(73) Assignee: Wacker Neuson Production Americas LLC, Menomonee Falls, WI (US)

( * ) Notice: Subject to any disclaimer, the term of this patent is extended or adjusted under 35 U.S.C. 154(b) by 37 days.

(21) Appl. No.: 12/409,005

(22) Filed: Mar. 23, 2009

(65) Prior Publication Data

US 2010/0239368 A1 Sep. 23, 2010

(51) Int. Cl.
*E01C 19/22* (2006.01)

(52) U.S. Cl. ..... 404/118; 404/114; 404/97

(58) Field of Classification Search ..... 404/96, 404/97, 114, 118, 84.1, 84.5, 84.8, 113, 120, 404/72, 75; 16/426, 422, 436
See application file for complete search history.

(56) References Cited

U.S. PATENT DOCUMENTS

| | | | | |
|---|---|---|---|---|
| 872,903 | A * | 12/1907 | Connelly | 403/68 |
| 2,306,126 | A * | 12/1942 | Jackson | 404/114 |
| 4,663,796 | A * | 5/1987 | Helling et al. | 15/144.2 |
| 4,752,156 | A | 6/1988 | Owens | |
| 4,798,494 | A | 1/1989 | Allen | |
| 4,838,730 | A * | 6/1989 | Owens | 404/114 |
| 4,861,188 | A * | 8/1989 | Rouillard | 404/75 |
| D333,245 | S * | 2/1993 | Griggs | D8/45 |
| 5,288,166 | A | 2/1994 | Allen et al. | |
| 5,605,415 | A * | 2/1997 | Shamblin | 404/118 |
| 6,089,787 | A | 7/2000 | Allen et al. | |
| 6,336,769 | B1 | 1/2002 | Cincis et al. | |
| 6,374,569 | B1 | 4/2002 | Suckow | |
| 6,488,442 | B2 * | 12/2002 | Boudreaux, Sr. | 404/97 |
| 6,550,214 | B2 * | 4/2003 | Aguilera | 52/749.13 |
| 6,758,631 | B2 | 7/2004 | Frankeny, II | |
| 6,981,819 | B1 | 1/2006 | Suckow et al. | |
| 7,175,365 | B1 * | 2/2007 | Breeding | 404/113 |
| 7,201,537 | B2 * | 4/2007 | Sina | 404/114 |
| 7,293,938 | B1 * | 11/2007 | Suckow et al. | 404/114 |
| 7,320,558 | B2 | 1/2008 | Quenzi et al. | |
| 2006/0291958 | A1 * | 12/2006 | Argento et al. | 404/118 |
| 2007/0292208 | A1 * | 12/2007 | Lutz et al. | 404/114 |

FOREIGN PATENT DOCUMENTS

EP 1669516 A1 6/2006

* cited by examiner

*Primary Examiner* — Thomas Will
*Assistant Examiner* — Matthew D Troutman
(74) *Attorney, Agent, or Firm* — Boyle Fredrickson, S.C.

(57) ABSTRACT

A portable vibratory wet concrete screed includes a blade, an exciter that is selectively driven to induce vibrations in the blade, at least one operator-manipulated handle connected to the blade and extending upwardly and rearwardly, a laser receiver mounted on the screed at a height above an upper end of the handle, and an indicator that is operatively connected to the receiver. The indicator provides a visual indication of the screed height relative to a desired grade. It is located remote from the receiver at a location which, when viewed from the perspective of a person in the vicinity of a screed operator, is at least substantially in a focal area containing the rear edge of the blade. The handle is mounted on the blade so as to be foldable from an upright, operative position in which it extends vertically and horizontally well beyond horizontal and vertical footprints occupied by a combination of the blade and the exciter to a stowed position in which it is positioned at least substantially entirely within the horizontal and vertical footprints.

19 Claims, 8 Drawing Sheets

PORTABLE VIBRATORY CONCRETE WET SCREED WITH REMOTE GRADE INDICATOR AND FOLDING HANDLES

FIELD OF THE INVENTION

The present invention relates generally to screeds for leveling freshly-poured or "wet" concrete, and more particularly, to a portable vibratory screed having a laser-based grade indicator system. The preferred grade indicator system includes a remote indicator that facilitates an operator's ability to operate the screed while monitoring screed operation. The invention also relates to a screed whose handles and any other protruding components can be folded within the vertical and horizontal footprints of the screed for transport.

BACKGROUND OF THE INVENTION

During a concrete pouring process, a material that includes aggregates, cement, and water is poured into an area that may be bounded by forms to contain the concrete material. As concrete is delivered into the pour area, a plurality of laborers, often called "puddlers," using tools such as rakes, come-alongs, and/or shovels, distribute the concrete material to generally the desired elevation. Still other laborers, commonly equipped with a piece of lumber or other straight member referred to as a "strike-off," move the strike-off across the concrete material. The process of manually striking-off the concrete material consolidates the material and forces the larger aggregate below the finished elevation. It also shapes the surfaces of the concrete to the desired slope or "grade." The levelness of the finished surface is highly dependant on the skill of the personnel handling the strike-offs. Additionally, manually striking-off the concrete material is very labor-intensive and requires a great deal of skill and experience to ensure a flat and properly inclined finished surface.

The advent of the portable vibratory screed greatly reduced the labor associated with leveling of the concrete material. Portable vibratory screeds commonly include a vibration-inducing mechanism attached to a board or "blade" and one or more operator-manipulated handles that extends from the blade. The vibration mechanism typically comprises an "exciter" formed from one or more eccentric weights driven by a motor. Operation of the exciter consolidates the concrete material such that, as the blade is moved across the wet concrete, the vibrating blade forces the larger aggregate below the surface of the material and works a highly cementatious material with smaller aggregates, often called "cream," to the finish surface of the material. Operator manipulation of the handle, as well as the rigidity of the blade, directly affects the flatness and inclination of the finished surface of the material. Accordingly, an operator's ability to control the pitch or tilt of the blade as well as the speed and direction of travel of the blade determines the flatness of the finished material.

The elevation of the finished material is commonly determined by the operator's visual inspection of the finish elevation in relation to the elevation references such as the forms. More recently, laser-based grade indication systems have been developed that provide precise position information that the operators can use as feedback to manipulate the screed. The typical laser system comprises a reference laser and a laser receiver. The laser is positioned on a tripod or similar support outside of the pour area and emits a laser beam in all directions at a known reference height. The laser receiver is mounted on a vertical post or mast supported on the screed blade at the reference height. The height of the receiver usually can be adjustable by adjusting the length of the mast but is fixed during any particular screeding operation. An indicator on the receiver indicates whether the receiver is level with, above, or below the desired reference plane or "grade" set by the laser transmitter. The operator relies on the grade information provided by the indicator as feedback to maintain the screed at the desired height and inclination.

In order to minimize interference from personnel and other obstructions in and around the pour area, some laser receivers are mounted on masts that extend over the operator's head. However, an operator cannot monitor operation of the working rear or leading edge of the screed blade while simultaneously viewing the receiver's indicator. He or she instead must repeatedly glance up and down so as alternately view the indicator and the leading edge of the screed. This constant glancing up and down can be very fatiguing to the operator. It also increases the chances of operator error.

In addition, the display provided by the typical commercial receiver's indicator is ill-suited for use on a concrete screed equipped a laser elevation/inclination indicator because its generic output only indicates whether the receiver is below or above a reference height. Some receivers do not provide any quantitative information about the magnitude of the offset. The operator therefore must use dead reckoning to determine the magnitude of screed manipulation that is required to obtain the proper height. Other systems attempt to provide an indication of the degree to which the screed is off-grade by flashing an out-of-grade indicator light at a frequency that progressively changes as the screed moves progressively further off-grade. These displays are not intuitive. They also require the operator to view the display for a relatively long period of time to process the information. That is, he or she must view the display sufficiently long to discern the frequency of the flashing display. The delay required for this processing time detracts from the operator's ability to react quickly to an out-of-grade condition and also distracts the operator from monitoring blade operation directly.

The need therefore has arisen to provide a portable vibratory wet concrete screed with a laser indicator whose receiver is relatively immune to interference from obstructions in the vicinity of the screed but whose indicator can be viewed by an operator while simultaneously monitoring operation of the screed blade.

The need also has arisen to provide a wet concrete screed with a laser elevation system that displays easily understandable qualitative and quantitative grade-based information.

Transporting wet concrete screeds having laser elevation systems and/or other portable vibratory wet concrete screeds can also prove a challenge. Screeds occupy "footprints" in both the horizontal and vertical planes defined by rectangular boxes the length, width, and height of which are defined by the maximum length, width, and height of the screed. Both the handles and the receiver masts of a wet concrete screed extend to a height of several feet well above the top of the exciter assembly, typically at least doubling the vertical footprint that would otherwise be occupied by the screed. In addition, the handles extend several feet behind the blade, typically at least tripling the horizontal footprint that would otherwise be occupied by the screed. While screeds have been provided with partially telescoping receiver masts and/or handles that fold approximately midway along their length to facilitate transport, the minimum vertical and horizontal footprints of these screeds are still typically at least double those of the blade and exciter combination. The only way to reduce the footprint of the screed to that of the blade and exciter assembly combination was to disassemble and remove the handles and receiver masts. Disassembling and removing those structures is a time-consuming process that risks loss of components. It also risks assembler error in reassembly.

The need therefore has arisen to provide a wet concrete screed in which the handle(s) and receiver masts (if present) can be folded flat onto the blade so as to reduce the vertical and horizontal footprints of the screed to essentially those provided by the screed and exciter combination.

SUMMARY OF THE INVENTION

In accordance with one aspect of the invention, a portable vibratory wet concrete screed includes a blade, an exciter that is selectively driven to induce vibrations in the blade, at least one operator-manipulated handle connected to the blade and extending upwardly and rearwardly from the blade, a laser receiver mounted on the screed at a height above an upper end of the handle, and an indicator that is operatively connected to the receiver. The indicator provides a visual indication of the screed height relative to a desired grade. It is located remote from the receiver at a location which, when viewed from the perspective of a person in the vicinity of a screed operator, is at least substantially in a focal area containing the working rear or trailing edge of the blade. The indicator preferably is located within 18" and more preferably within 14" of the rear edge of the blade.

In a preferred embodiment, the indicator includes a display that indicates a change of magnitude at which the screed is off-grade without changing a frequency of indicator flashing. More preferably, the display includes a plurality of lights that are illuminated in combinations that vary with the magnitude at which the screed is off-grade.

In accordance with another aspect of the invention, a portable vibratory screed includes a blade, an exciter that is selectively driven to induce vibrations in the blade, and at least one operator-manipulated handle that is connected to the blade and that extends upwardly and rearwardly. The handle is mounted on the blade so as to be foldable 1) from an upright, operative position in which the handle extends vertically and horizontally well beyond horizontal and vertical footprints occupied by a combination of the blade and the exciter; and 2) to a stowed position in which the handle is positioned at least substantially entirely within the horizontal and vertical footprints.

The screed of this aspect may be a wet concrete screed with a laser grade or elevation system, in which case it additionally includes a mast that supports a laser receiver that is mounted on the screed. The mast is foldable from an upright, operative position in which the mast extends well above the vertical footprint to a stowed position in which the mast is positioned at least substantially entirely within the horizontal and vertical footprints.

Folding may be facilitated by providing a mount assembly via which the handle and the receiver are mounted on the blade. The mount assembly preferably includes a base and a pedestal that is mounted on the base so as to rotate about a vertical axis. The handle and the receiver mast are each mounted on the pedestal so as to be pivotal about a horizontal axis.

Other aspects of the invention include a method of operating a wet concrete screed with laser screed elevation system having a remote indicator and a method of folding at least a handle of a wet concrete screed for screed transport or storage.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. It is hereby disclosed that the invention include all such modifications.

BRIEF DESCRIPTION OF THE DRAWINGS

The drawings illustrate the best mode currently contemplated of practicing the present invention. In the drawings.

DETAILED DESCRIPTION OF THE PREFERRED EMBODIMENTS

Figure 1:
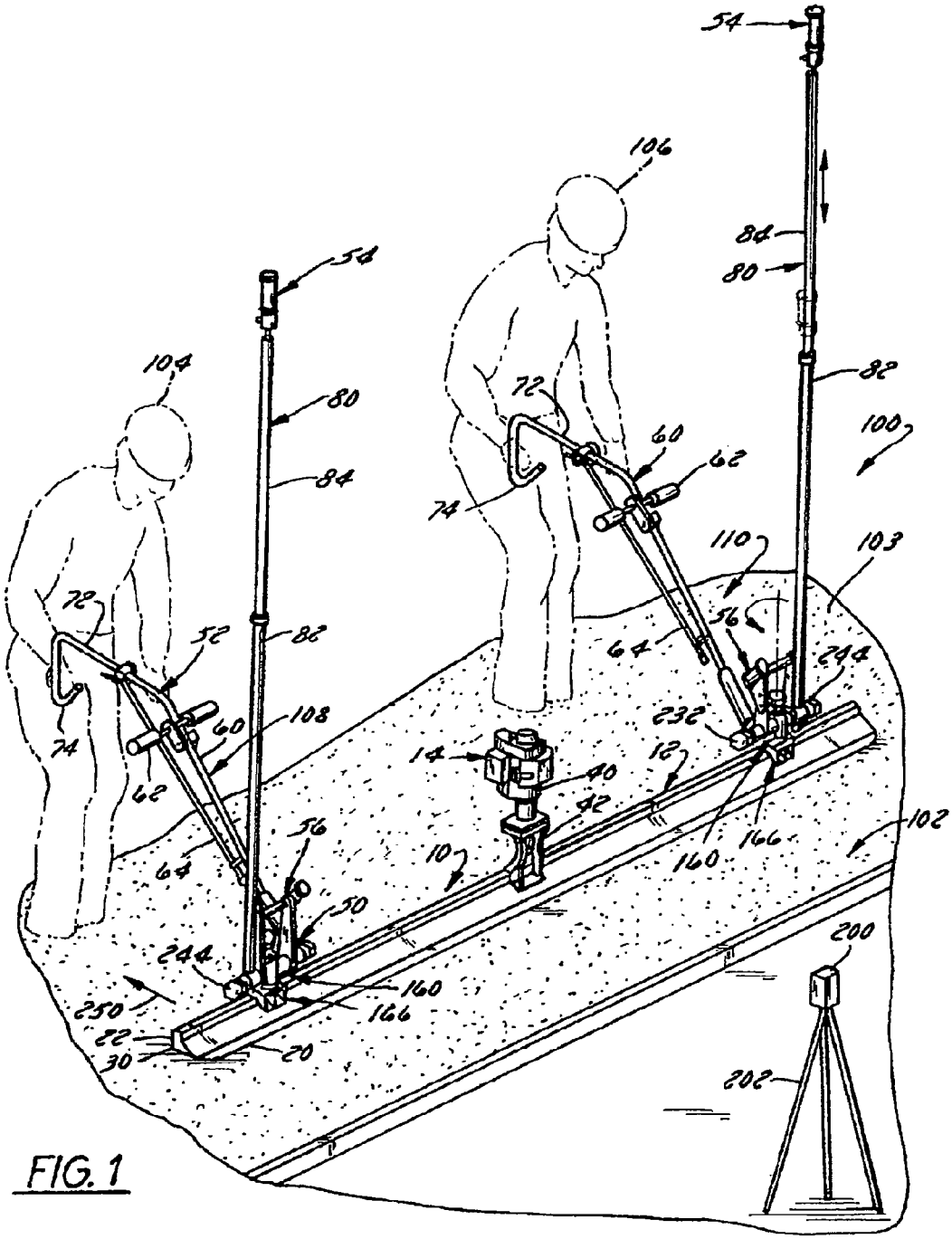
FIG. 1 is an isometric view of a portable vibratory screeding system according to one embodiment of the present invention.

FIG. 1 shows a portable vibratory screed system 100 according to a one embodiment of the present invention in use on a pour area 102 as it is used to level freshly poured concrete 103 in area 102. System 100 includes a portable vibratory screed 10 located within the pour area 102 and a laser transmitter 200 positioned outside of that area. The transmitter 200 cooperates with receivers 54 and indicators 56 on the screed 10 to provide an indication of the height of the screed 10 relative to a desired grade. As used herein, the "desired grade" is the desired height of the concrete at any particular location in the pour area 102. That height typically is constant within a given pour area but may vary within the pour area to provide a desired slope to the finished concrete. Operators 104, 106, located at operator's stations 108 and 110 behind the screed 10, manipulate the screed 10 to level the concrete at the desired grade. While a relatively long two person screed 10 is illustrated having two operator's stations 108, 110 and their attendant equipment, the invention is equally applicable to a relatively short one-person screed having only a single operator's station.

Still referring to FIG. 1, the laser transmitter 200 is mounted on a vertically adjustable support such as a tripod 202 positioned outside of the pour area 102. It should be mounted sufficiently high so that the transmitted laser beam is not obstructed by personnel and other low-level obstructions in the pour area 102. A beam height of at least 6 feet or even higher is preferred. The laser 200 preferably is a 360 degree laser that creates a plane-like laser projection that is projected in a full 360 circle from the emitter. A suitable laser is available from AGL of Little Rock Ark.

Figure 6:
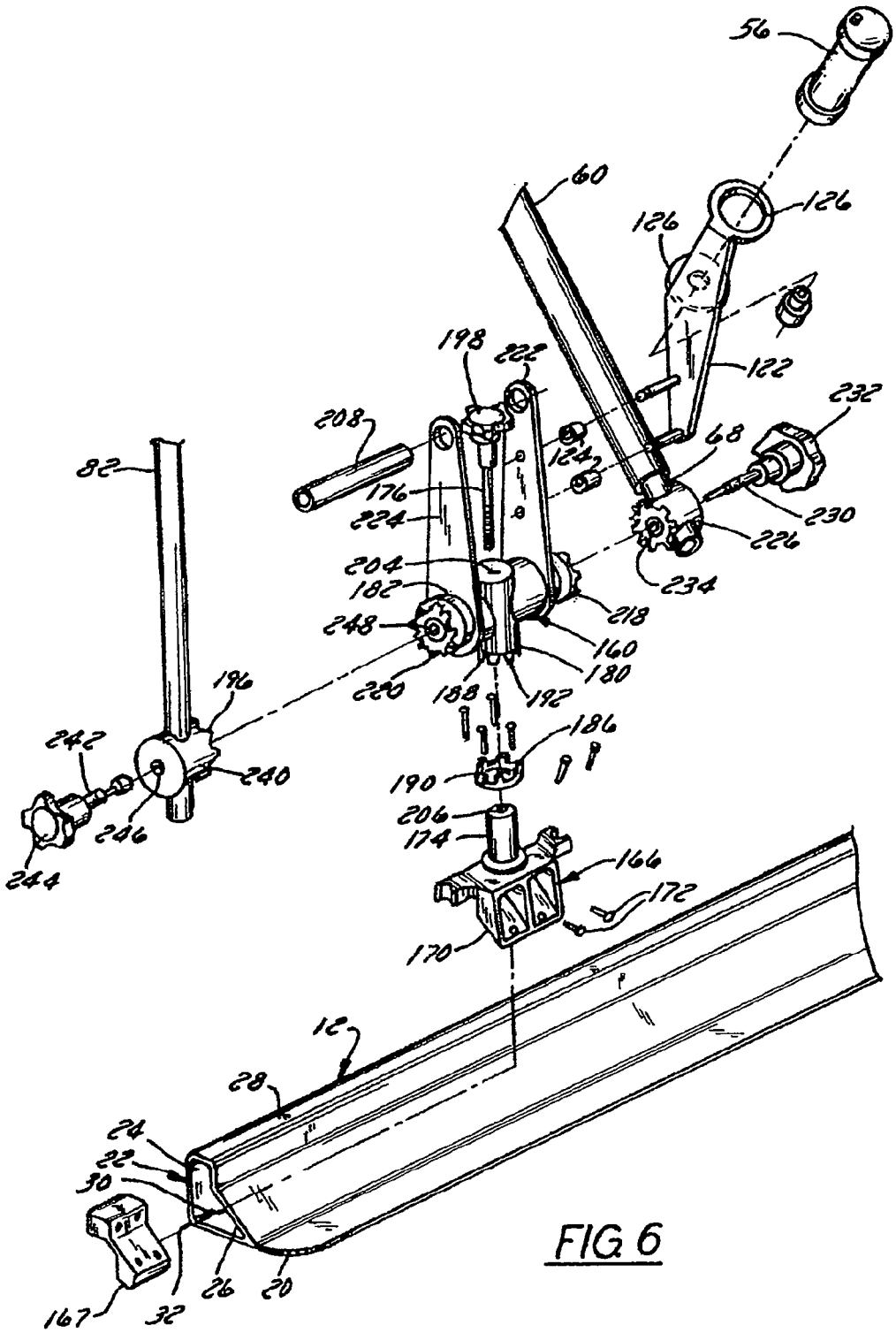
FIG. 6 is an exploded isometric view of the mount assembly of FIG. 5.

Portable vibratory screed 10 includes a board or blade 12 having a vibration mechanism or exciter 14 attached thereto. Blade 12 is generally b-shaped when seen in cross section in order to resist bending or twisting along its length. It is formed from extruded aluminum or other material such as magnesium and includes a bottom plate 20 extending the entire width of the blade 12 and a top, reinforced section 22 that extends over approximately the trailing or rear half of the bottom plate 20. (Terms such a "front", "rear", "leading", "trailing," etc. are used strictly for convenience and a frame of reference). The front portion of bottom plate 20 may be either planer, curved, or inclined. As best seen in FIG. 6, the reinforced section 22 includes first and second longitudinally extending, transversely spaced walls 24 and 26 that extend upwardly from the bottom plate 20. The bottom of the rear edge of the rear wall 24 forms the rear or leading edge as the operator pulls the screed through the concrete while walking backwards. The front wall 26 is inclined forwardly at its front end. An upper wall 28 extends between walls 24 and 26 to enclose a cavity. An end plate 30 is connected to each end of blade 12 to enclose the cavity, and thus, ensure that the material being screeded is not deposited within the cavity. A blade of this general configuration is disclosed in more detail in commonly-assigned U.S. patent application Ser. No. 11/763, 239 (the '239 application), the subject matter of which is hereby incorporated by reference.

The exciter 14 may comprise any powered device that can be operated to induce vibrations in the blade. The illustrated exciter includes an engine 40 that is supported on a pedestal 42 mounted on top of the blade 12 near its rear wall 24. The engine 40 drives one or more eccentric masses (not visible) to impart vibrations to blade 12. The vibration of blade 12 consolidates and levels a material passed thereunder.

The operator's stations 108, 110 are mirror images of one another and located symmetrically of a centerline of the blade 12. They may be mounted at any desired positions along the length of the screed 10, such as at minimum vibrational nodes on the blade 12 as described in the '239 application. Right station 108 will be described, it being understood that the description applies equally to the left station 110.

Figure 2A:
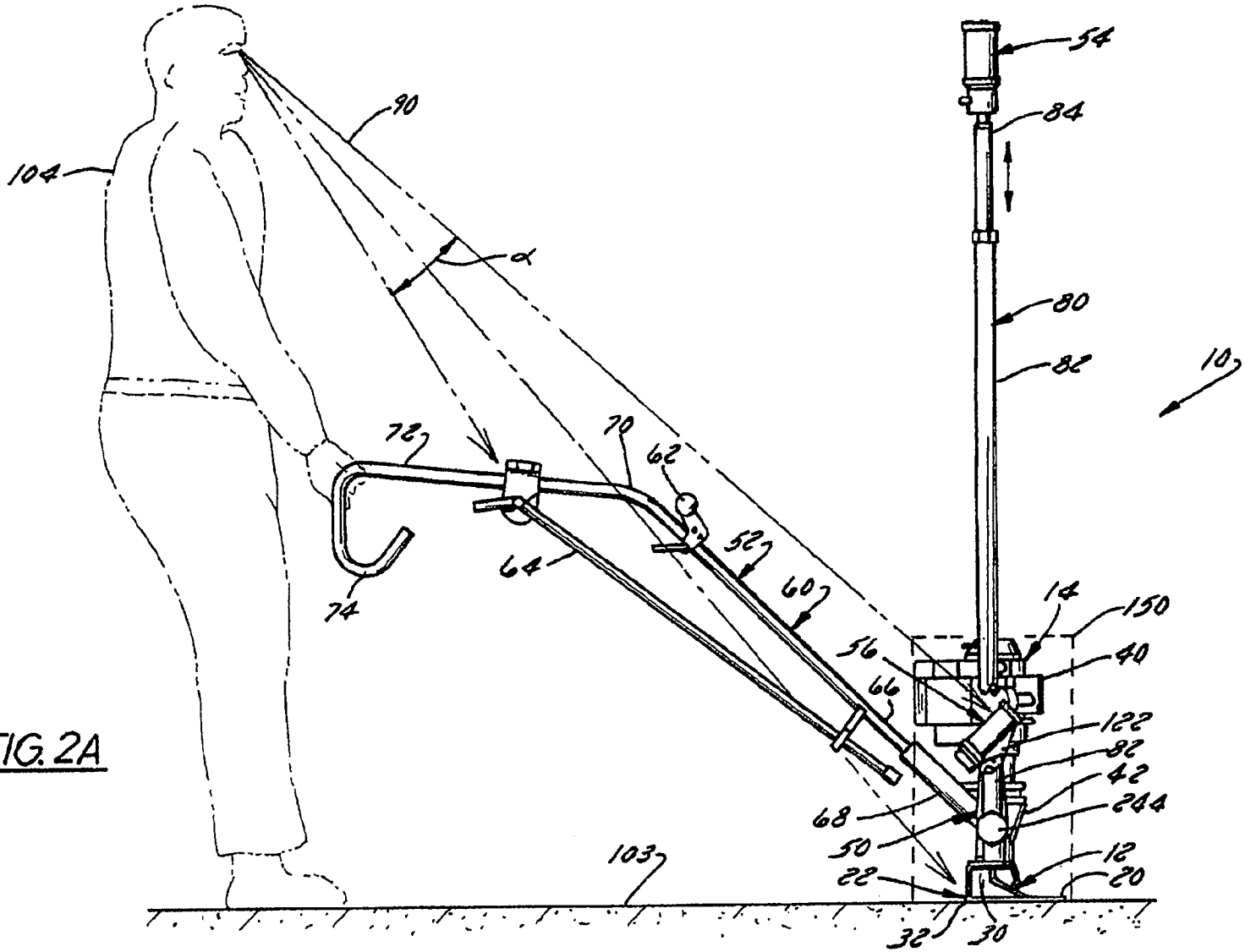
FIG. 2A is side elevation view of a portable vibratory screed of the system shown in FIG. 1, showing an operator located in a first operating position.
Figure 2B:
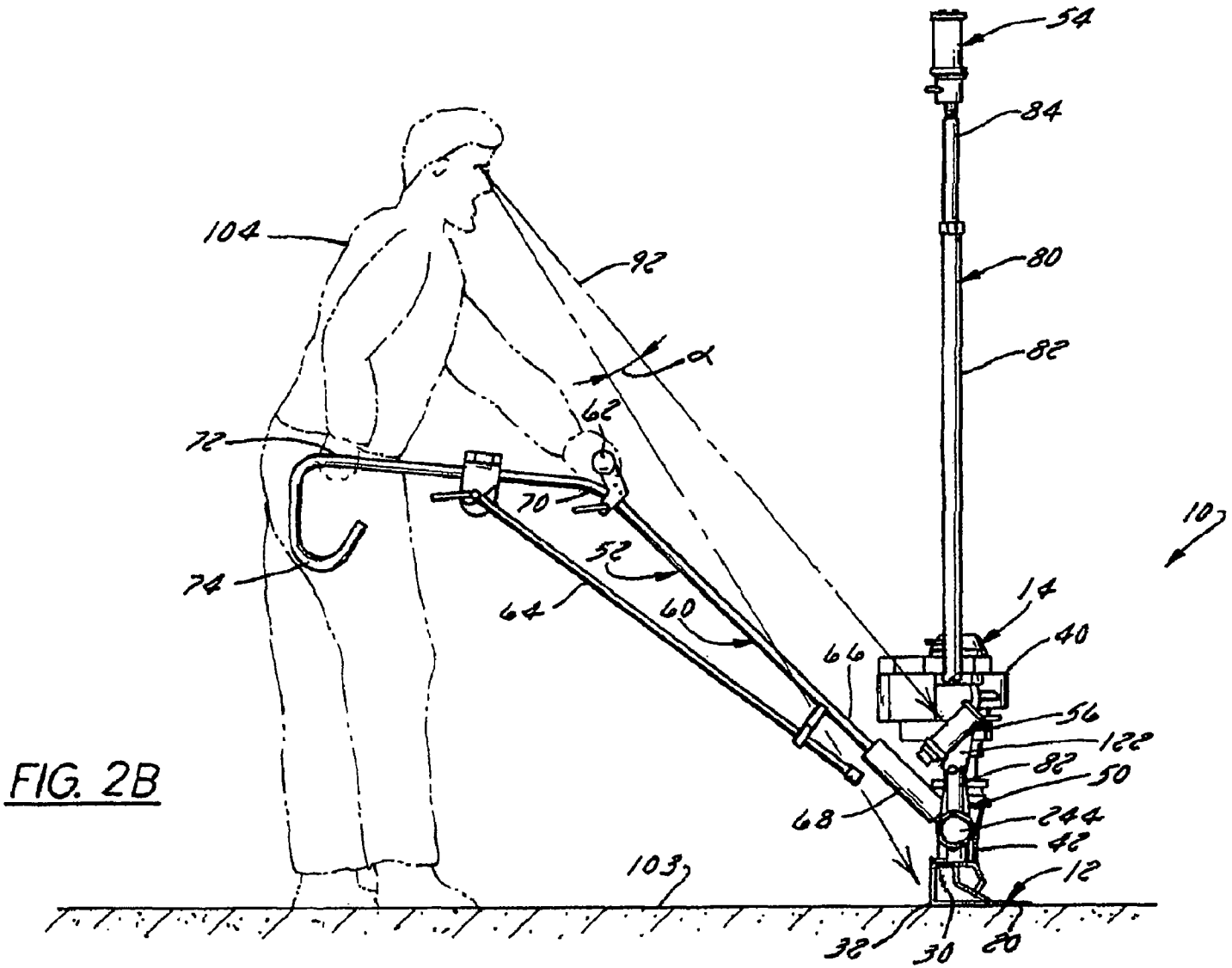
FIG. 2B corresponds to FIG. 2A and shows the operator in a second operating position.

Referring to FIGS. 1-2B, station 108 includes a foldable mount 50 that supports a handle assembly 52, a laser receiver 54, and an indicator 56. Handle assembly 52 includes a handle tube 60, a handlebar 62, and a kickstand 64. Handle tube 60 extends upwardly and rearwardly from a lower end 66 that is received in and fixed to a mounting tube 68. Mounting tube 68 is supported on the mount assembly 50 as described below. Handle tube 60 is curved at a location 70 between its lower and upper ends to provide a horizontal rear end section 72. Section 72 is curved downwardly at its outer end to produce a generally C-shaped hand grip 74 that can be gripped by one or both hands of the operator 104. The handlebar 62 is clamped or otherwise affixed to the handle tube 60 just beneath the bend 70. It may comprise a straight bar having left and right handgrips as shown, a rectangular loop having an upper center handgrip, or any other structure having one or more handgrips accessible by one hand of operator 104 while the operator gasps the rear hand grip 74 with the other hand. This configuration permits an operator 104 to either stand upright as shown in FIG. 2A or to lean forward as shown in FIG. 2B. If the operator 104 stands upright, he can either grasp the rear handgrip 74 with both hands or grasp hand grip 74 with one hand while resting the other on the horizontal section 72 of the handle tube 60. If he leans forward, one hand can grasp the rear hand grip 74 or rest on the horizontal section 72 of the handle tube 60, and the other hand can grasp the front handlebar 62.

Referring to FIGS. 1, 2A, and 2B, receiver 54 preferably has a 360° range so that it can receive the transmitted laser signal without having to be turned towards the reference laser 200 as the screed is used in different locations on the jobsite. A preferred 360° receiver is available from AGL under the model number WR360. A preferred visual display provided by the receiver 54 is discussed below. The receiver 54 is mounted on top of a telescopic mast 80 that provides a variable distance between receiver 54 and the blade 12. Telescopic mast 80 includes lower and upper sections 82 and 84. A bottom end of the lower portion 82 is affixed to the mount assembly 50 as described in more detail below. The upper section 84 is telescopically received in the lower portion 82 at its bottom end and bears the receiver 54 on top of its upper end. When the mast 80 is properly positioned, receiver 54 is coplanar with the transmitter of the laser 200 at a level above the operator's head and other low-level obstructions in and around the pour area 102. Receiver 54 includes a visual and/or audible display that provides the operator 104 and others in the pour area 102 an indication of the position of the screed relative to grade.

Figure 5:
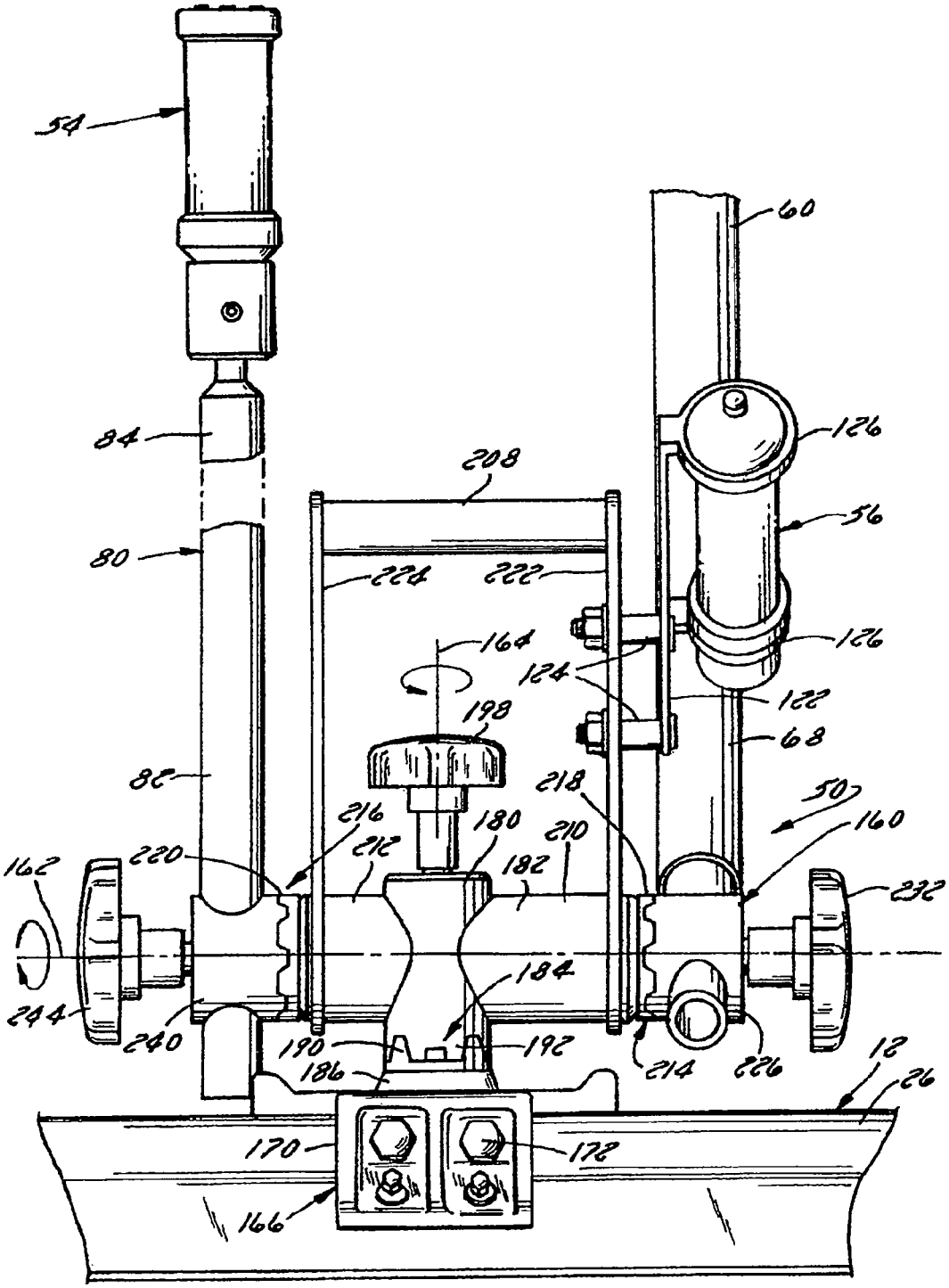
FIG. 5 is an isometric view of a mount assembly of the portable vibratory screed shown in FIGS. 1-2B.

While the receiver 54 provides usual information regarding grade, more user-friendly operation is provided by the remote indicator 56 due to its positioning. That is, the indicator 56 is provided at a location that permits the operator 104, as well as puddlers and other personnel located in the vicinity of the operator 104, to simultaneously focus on both the indicator 56 and the working rear edge 32 of the blade 12. Depending on each individual's height and posture, the eyes of these personnel typically are located 4 feet to 5½ feet behind and 5 feet to 6 feet above and behind the working edge of the blade 12. Their line of sight 90 (FIG. 2A), 92 (FIG. 2B) provides a focus area that extends in an arc $\alpha$ of about 15° which is preferably centered on the working edge 32 of the blade 12. The indicator 56 should be located within that arc. It also should be located in the vicinity, or at a common focus distance, of the handle 52 within 18", and more preferably within 14" of the rear working edge of the blade 12. Mounting the indicator 56 within this area, or the area bounded by the area associated with the line of sight and the focus distance associated with the working edge 32 of blade 12, permits operator 104 to focus on or simultaneously view both the indicator 56 and the working edge 32 of the blade 12 whether he is standing in the upright position of FIG. 2A or the forward-leaning position of FIG. 2B. Indicator 56 could be mounted on the handle mounting tube 68. In the currently preferred embodiment, it is mounted on a bracket 122 affixed to a support leg 222 for the mount assembly handle 208 (detailed below) as best seen in FIG. 5. The bracket 122 is bolted to the support leg 222 and extends laterally from the support leg 222 to a position in which the indicator 56 is positioned on a line bisecting the handle 52. Shock mounts 124 preferably are positioned between the support leg 222 and the bracket 122 to reduce the imposition of vibrations to the indicator 56. The indicator is mounted on the bracket 122 by straps 126 that are formed integrally with or coupled to the bracket 122 or by a magnetic mount. The indicator 56 extends at an angle of about 45° relative to the horizontal so as to position its display face generally perpendicularly to the operator's line of site 90 (FIG. 2A) or 92 (FIG. 2B).

It should be noted that placing the indicator 56 relatively close to the blade 12 not only permits the operator 104 to view the indicator 56 and the screed leading edge 32 simultaneously, but also reduces the imposition of vibrations on the indicator 56. In fact, at a maximum typical operating engine speed of 8000 RPM, the indicator 56 is subject to 7.9 G of vibrations. It would be subject to 26.6 G if it were mounted at the middle of the handle assembly 52.

Figure 3:
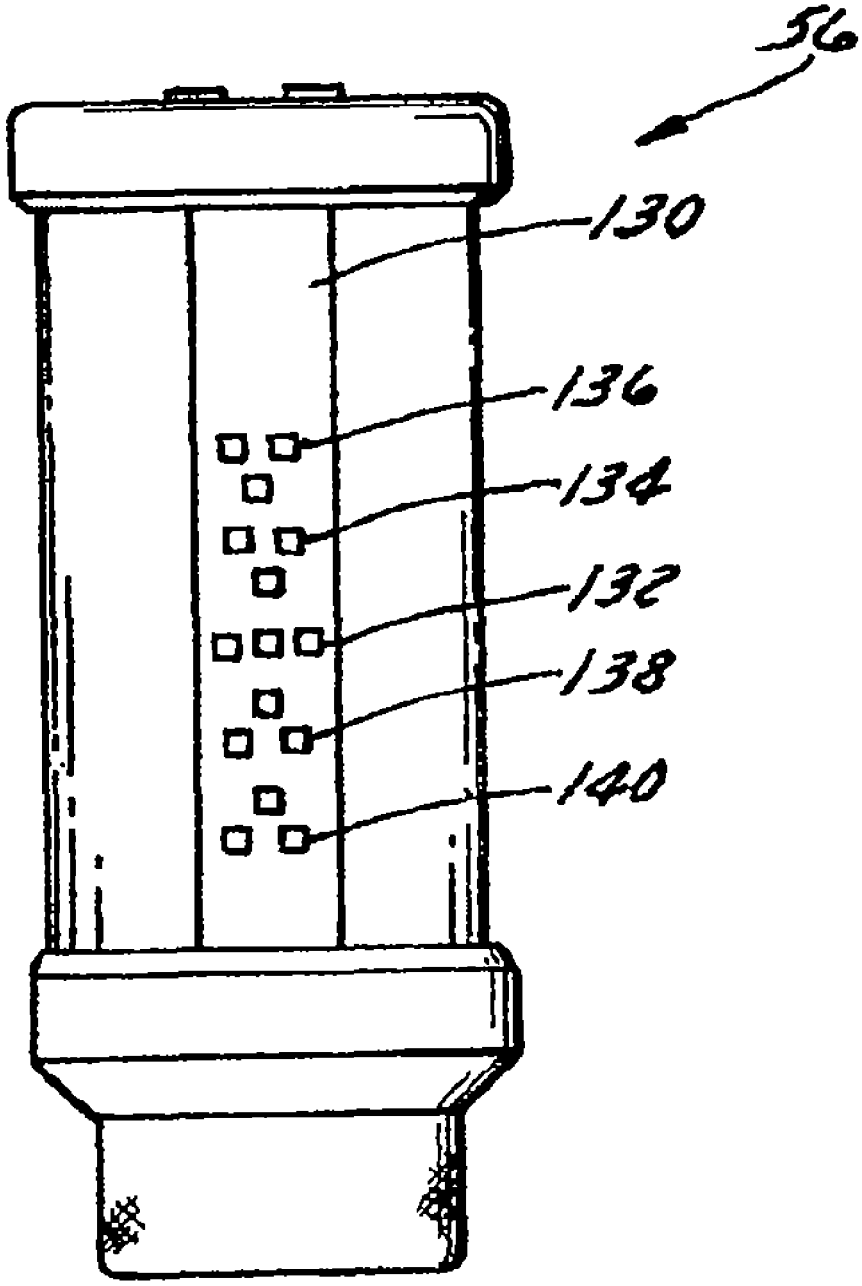
FIG. 3 is an elevational view of a remote indicator of the portable vibratory screed of FIGS. 1-2B.

Referring to FIG. 3, the indicator 56 takes the form of a tubular body 130. It has a vertical display panel 130 having a plurality of sets 132, 134, 136, 138 and 140 of battery-powered lights arranged and activated as described below. The lights may, for example, take the form of LCDs or LEDs.

LEDs are currently preferred because they offer low cost, low-voltage, multicolored display capability. The illustrated lights are activated to display grade-dependent information. If desired, other lights (not shown) could be used to designate ON-OFF status, a low battery condition, or other faults, errors or conditions.

The indicator 56 is electronically connected to the receiver 54 so as to display grade-dependent information based on the signal transmitted to the receiver 54 by the laser transmitter 200. The electronic connection may be achieved through a cable, but a wireless connection is preferred because it is more robust than a cable-based system, whose cable is prone to breakage. Cables also obstruct the line of sight of personnel in the vicinity of the screed 10. The wireless signal may be transmitted by IF signal or IR signal. In the preferred embodiment, the signal takes the form of a Bluetooth® signal.

Figure 4:
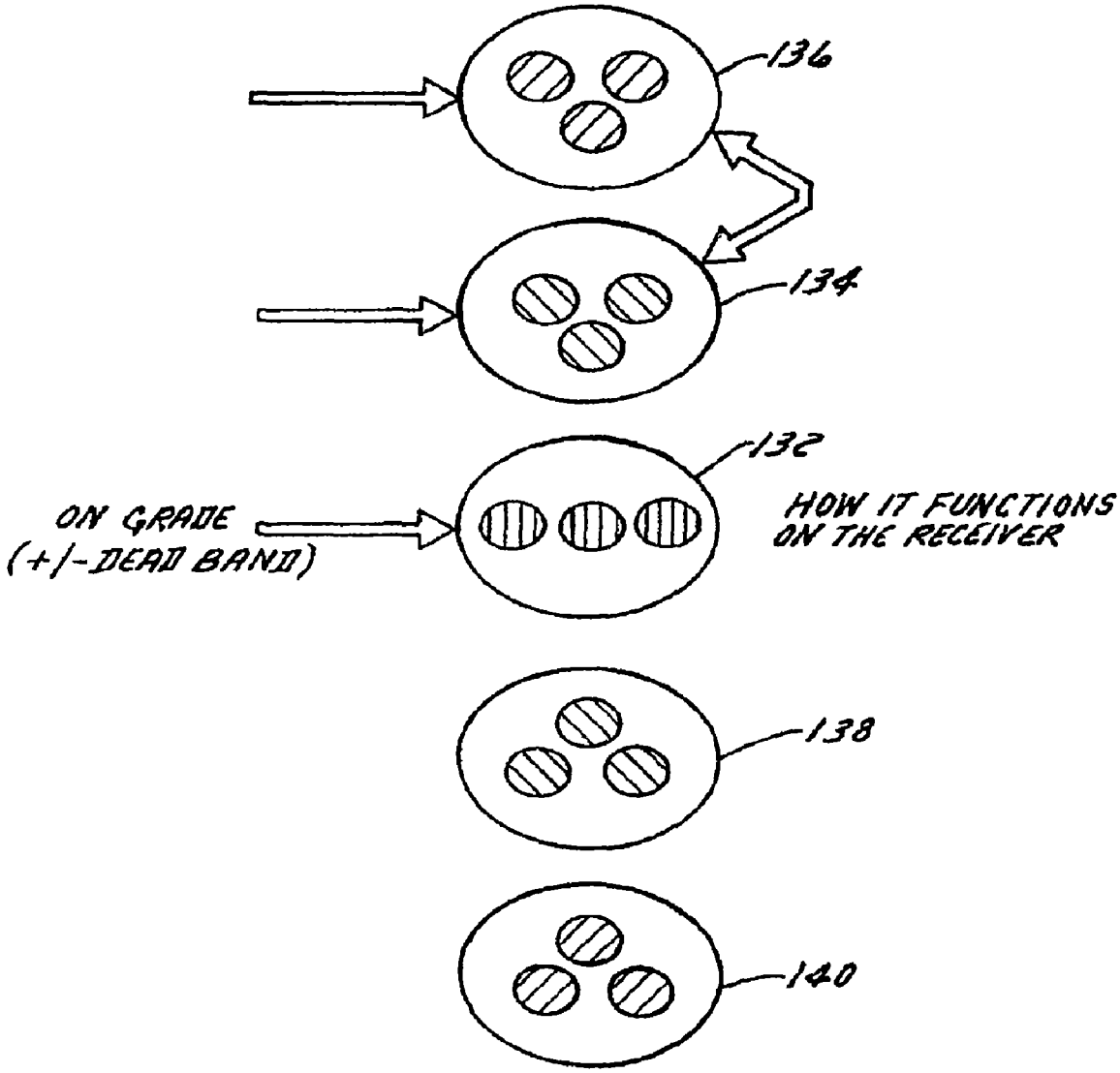
FIG. 4 schematically illustrates an out-of-grade dependent display sequence of lights on the indicator of FIG. 3.

The nature of the display provided on the indicator 56 may be the same as or different from that on the receiver 54. In the preferred embodiment, the out-of-grade information displayed by both the receiver 54 and the indicator 56 is the same. In order to provide the user-friendly, intuitive, output, the display preferably indicates a change of magnitude at which the screed 10 is off-grade by a mechanism other than changing the frequency at which the lights flash. In a preferred embodiment, the sets of lights 132-140 are illuminated in combinations that vary with the magnitude at which the screed is off-grade. Turning now to FIG. 4, this effect is achieved in the present embodiment by providing five sets of lights 132-140 with each set containing three LEDs. The first, center set 132 consists of three green LEDs that are aligned in a horizontal line and, when illuminated, show that the screed is in-grade within a tolerance of, e.g., 4 mm. The second and third sets of lights 134 and 136 are located progressively above the first set 132 and are orange and red, respectively, when illuminated. The three lights of each of these sets are arranged in a triangle that replicates a downwardly-extending arrow. These two sets 134 and 136 are illuminated in a cascading fashion as the screed 10 becomes progressively higher above grade. For example, if the screed 10 is relatively close to grade, such as within 4 to 9 mm above grade, the first and second sets 132 and 134 will both be illuminated. The second set 134 will be illuminated by itself if the out-of-grade magnitude is at a medium level, such as in the 9 mm 22 mm range. Both the second and third sets of lights 134 and 136 will be illuminated at the same time at a more severe out-of-grade condition of more than 22 mm to 29 mm. If the screed becomes even more out-of-grade, such as more than 29 mm, then only the third, red set of lights 136 will be illuminated. The fourth and fifth sets 138 and 140 are mirror images of the second and third sets 134 and 136. They are illuminated in the same manner as the second and third sets 134 and 136 as the screed moves progressively lower below grade. These responses are summarized more succinctly in Table 1:

TABLE 1

Indicator Response to Out-of-Grade Condition

| Out-of-Grade Condition (Absolute Value in mm) | Response |
|---|---|
| 0 to 4 | Green |
| 4 to 9 | Green and Orange |
| 9 to 22 | Orange |
| 22 to 29 | Orange and Red |
| 29 to 45 | Red |

The lights preferably are illuminated at a constant flashing frequency rather than in a progressively changing flashing manner to provide an instantaneously discernable indication of screed height relative to the desired grade.

Figure 7:
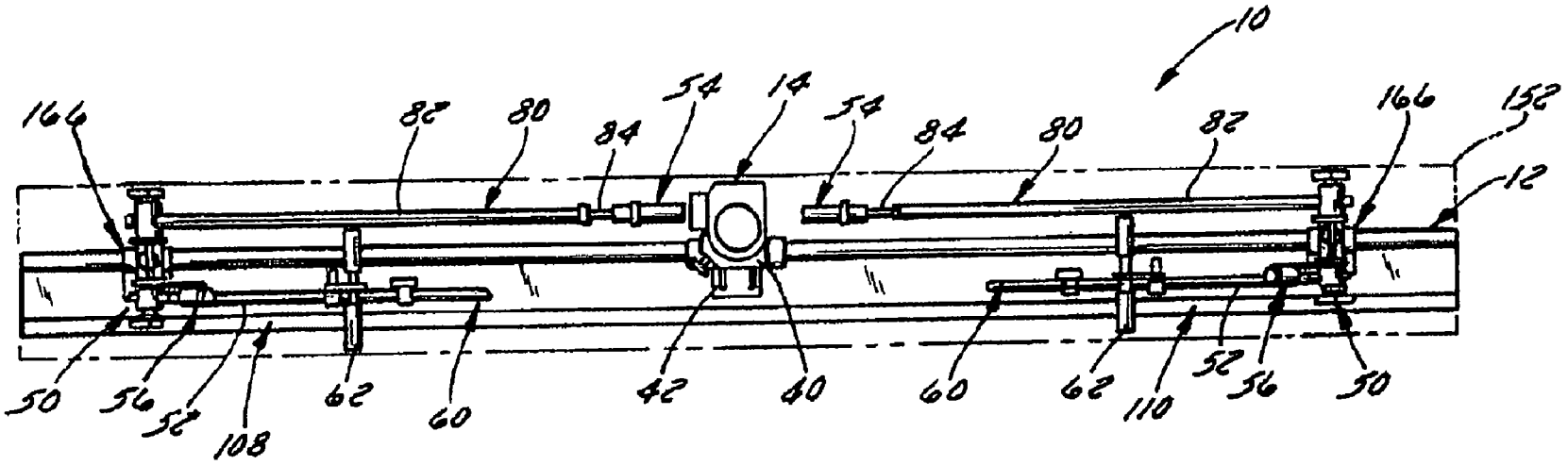
FIG. 7 is a top plan view of the portable vibratory screed of FIGS. 1-2B, showing the screed configured for transport.

The exciter 14 and a blade 12, in combination, have "footprints" or rectangular horizontal and vertical areas that contain the exciter and blade. More specifically, referring to FIGS. 2A and 2B, a vertical footprint 150, extending vertically and laterally of the screed 10, is bordered by the bottom of the blade 12, the rear-most surface of the exciter 14, the uppermost surface of the exciter 14, and the front edge of the blade 12. Referring to FIG. 7, a horizontal footprint 152, extending laterally and longitudinally of the screed 10, is bordered by the front, rear, and side edges of the blade. The mount assembly 50 of each operator's station 104 is designed to permit the handle 52 to fold 1) from an upright, operative position, seen in FIGS. 1-2B, in which it extends well beyond both the horizontal and vertical footprints; 2) to a stowed position, shown in FIG. 7, in which it is positioned at least substantially entirely within those footprints. The mount assembly 50 similarly also permits the mast 80 to fold from the upright, operative position of FIGS. 1-2B in which the mast 80 extends well above the vertical footprint 150 to the stowed position of FIG. 7, in which the mast 80 is positioned at least substantially entirely within the horizontal and vertical footprints 150 and 152. Referring to FIG. 5, this folding is made possible by providing the mount assembly 50 with a pedestal 160 on which the handle 52 and receiver mast 80 are pivotal about a horizontal axis 162 and which itself is rotatable about a vertical axis 164.

Turning now to FIGS. 5 and 6, the preferred mount assembly includes a base 166 that is fixed to the blade 12 and that rotatably supports the pedestal 160. The base 166 has a body 170 having a notched bottom contour that is shaped to match the contour of the upper surface of the blade 12. It is attached to the blade by bolts 172. A central shaft 174 extends upwardly from the body 170 of the base 166 for receiving the pedestal 160.

Still referring to FIGS. 5 and 6, the pedestal 160 of the mount assembly 50 comprises a center weldment or cast or machined block having intersecting vertical and horizontal tubes 180 and 182. The vertical tube 180 is sized to slip over the shaft 174. First and second sections 186 and 188 of a clamp assembly 184 are located at the bottom of the shaft 174 and the bottom of the tube 180, respectively. The clamp sections 186 and 188 have mating teeth or lugs 190, 192 that mesh with one another when the clamp assembly 184 is tightened to prevent relative rotation of the two clamp sections 186 and 188. A threaded shaft 176, having a knob 198 on the end, extends through an opening 204 in the closed upper end of the tube 180 and into an internally threaded bore 206 in the shaft 174. Tightening of the knob 198 locks the first and second clamp sections 186, 188 together. Loosening of the knob 198 sufficiently to permit the second clamp section 188 to move axially away from the first section 186 permits the teeth 192 of the second clamp section 188 to rotate past the teeth 190 of the first clamp section 186. The use of a clamp 184 having the toothed clamp sections 186, 188 assures that the primary retention forces come from the engagement of the mating teeth or lugs 190, 192 rather than from compressive forces, hence providing a more secure clamping effect. The pedestal 160 can be rotated by grasping an integral handle 208 and twisting it, thereby driving the clamp section 188 on the pedestal 160 to rotate past the clamp section 186 on the base 166. The teeth or lugs are located relative to one another and to the mount assembly 50 as a whole such that the pedestal 160 is capable of being locked in only two positions, namely, the position shown in FIGS. 1-2B in which the horizontal tube 182 extends in parallel with the longitudinal centerline of blade 12 and the position shown in FIG. 7 in which the horizontal tube 182 extends perpendicularly to longitudinal centerline of the blade 12.

Still referring to FIGS. 5 and 6, the horizontal tube 182 of the pedestal 160 includes first and second sections 210 and 212 that extend outwardly from respective edges of the vertical tube 180. Opposed free ends of the tube sections 210 and 212 each form a first clamp section 218, 220 of a respective clamp assembly 214, 216. Support legs 222, 224 for the handle 208 are welded on or otherwise affixed to sections 210, 212 intermediate the vertical tube 180 and the opposed ends. The handle 208 and support lets 222 and 224 preferably are formed as single weldment. The handle 208 is shown as separated from that weldment in FIG. 6 only for the purposes of illustration.

A reduced diameter bottom end of the handle mounting tube 68 extends radially through a second section 226 of the first clamp assembly 214 and is rigidly affixed thereto by, e.g., welding or casting. The first and second horizontal clamp assemblies 214, 216 are conceptually the same as the vertical clamp assembly 184. A threaded shaft 230, having a knob 232 on the end, extends axially through a bore 234 in the second clamp section 226 of the clamp assembly 214 for selective mating with an internally threaded bore (not shown) in the first section 218. The clamp assembly 214 is locked by tightening the knob 232 and unlocked by loosening it. Mating teeth or lugs of the clamp sections 218, 226 are located relative to one another and to the mount assembly 50 as a whole such that the handle mounting tube 68 is capable of being locked in only two positions, namely, the position shown in FIGS. 1-2B in which the handle 52 extends upwardly at an angle, and the position shown in FIG. 7 in which the handle 52 folds flat against the upper surface of the blade 12.

Similarly, a bottom end of receiver mast section 82 extends through a second section 240 of the second clamp assembly 216 and is rigidly affixed thereto by, e.g., welding or casting. A threaded shaft 242, having a knob 244 on the end, extends axially through a bore 246 in the second clamp section 240 for selectively mating with an internally threaded bore 248 in the first clamp section 220. The second clamp assembly 216 is locked by tightening the knob 244 and unlocked by loosening it. The mating teeth or lugs on the first and second clamp sections 220 and 240 are located relative to one another and to the mount assembly 50 as a whole such that the receiver mast 80 is capable of being locked into only two positions, namely, the position shown in FIGS. 1-2B in which the mast 80 extends vertically, and the position shown in FIG. 7 in which the mast 80 folds flat against the upper surface of the blade 12.

To ready the screed 10 for transport, the operator first loosens the knob 198 to unclamp the pedestal clamp assembly 184. He or she then grasps the handle 208 and rotates the pedestal 160 90° and retightens the knob 198. He or she then loosens the knob 232 of the handle clamp assembly 214, folds the handle 52 down, and retightens the knob 232. The process is then repeated with the receiver mast clamp assembly 216. All clamp components are permanently attached to other, larger components of the screed 10. The clamp assemblies need not and in fact cannot be disassembled when preparing the screed 10 for transport, so part losses are unlikely.

It should be noted that the folding mount assemblies of the type described above are also suitable for use with screeds lacking a laser receiver mast, in which case only the handle or handles would fold.

Referring again to FIG. 1, during operation of the portable vibratory screed 10, blade 12 is moved in a direction or a screeding direction, indicated by arrow 250, across a material to be leveled, struck off, or floated. When an operator 104 or 106 desires to increase an elevation or raise a grade, handle 52 is rotated upward, thereby allowing more material to pass under rear working edge 32. Conversely, when an operator 104 or 106 desires to lower an elevation or cut the grade, rotation of handle 52 downward lowers leading edge 32, thereby decreasing the elevation of the finish material. Positioning of a working edge of blade 12 thus is controlled by an operator's manipulation of handle 52. The front edge of blade 12 "floats" the material, and thereby, closes a surface structure of the material. That is, as blade 12 moves across the surface of the wet concrete, blade 12 forces the larger aggregate below the finish surface of the material and raises the cream of the material.

During this process, the laser transmitter 200 sends a 360 degree signal that is received by receivers 54. Each receiver generates a display, described above, that indicates whether the screed 10 is above, below, or level with the desired grade set by the transmitter 200. The same information is displayed on each indicator 56, which is continuously monitored by the associated operator 104 or 106 and used as feedback for manipulating the handle 52. Because the out-of-grade information is provided in an intuitive, instantaneous fashion rather than by flashing lights at a frequency that varies with the degree that the screed is out of grade, the operator 104 or 106 can process the displayed information essentially instantaneously. Puddlers and others in the pour area 102 can also rely on information provided by the indicator and/or the display on the receivers as feedback for their operations.

It is appreciated that many changes and modifications could be made to the invention without departing from the spirit thereof. Some of these changes, such as its applicability to riding concrete finishing trowels having other than two rotors and even to other self-propelled powered finishing trowels, are discussed above. Other changes will become apparent from the appended claims. It is intended that all such changes and/or modifications be incorporated in the appending claims.

What is claimed is:

1. A portable vibratory wet concrete screed comprising:

a blade for leveling wet concrete, the blade having a front edge and a rear edge; an exciter that is selectively driven to induce vibrations in the blade;

at least one operator-manipulated handle that is connected to the blade and that extends upwardly and rearwardly from the blade;

a laser receiver that is mounted on the screed at a height above an upper end of the handle; and an indicator that is operatively connected to the receiver and that provides a visual indication of the screed height relative to a desired grade, wherein the indicator is located remote from the receiver at a location which, when viewed from the perspective of a person standing in the vicinity of a screed operator, is at least substantially in a focus area so as to be capable of concurrently viewing the indicator and at least a portion of the rear edge of the blade;

wherein the handle and the receiver are mounted on the blade via an adjustable mount assembly, the mount assembly including a base that is supported on the blade and a pedestal that is mounted on the base so as to rotate about a vertical axis wherein the handle and the receiver are foldable from an upright, operative position in which they extend well beyond at least one of a horizontal footprint and a vertical footprint occupied by the combination of the blade and the exciter, to a stowed position in which the handle and the receiver are positioned at least substantially entirely within said footprints.

2. The screed as recited in claim 1, wherein the indicator is located within 18" of the rear edge of the blade.

3. The screed as recited in claim 2, wherein the indicator is located within 14" of the rear edge of the blade.

4. The screed of claim 2, wherein the indicator is mounted on the handle beneath a handgrip thereof and is inclined upwardly and forwardly relative to the handle.

5. The screed of claim 1, wherein the indicator includes a display that visually indicates a change of magnitude at which the screed is off-grade without changing an operating frequency of the indicator.

6. The screed of claim 5, wherein the display includes a plurality of lights that are illuminated in combinations that vary with the magnitude at which the screed is off-grade.

7. The screed of claim 1, wherein the handle and the receiver are each supported on the pedestal of the mount assembly so as to pivot about a horizontal axis.

8. The screed of claim 7, wherein the receiver is mounted on a mast that is pivotally mounted on a first side of the mounting portion of the mount assembly and the handle is pivotally mounted on a second side of the mount assembly.

9. The screed of claim 1, wherein the handle, the receiver, and the indicator are located in the vicinity of a first end of the blade, and further comprising a second handle, a second receiver, and a second indicator all mounted on the blade in the vicinity of a second end thereof.

10. A portable vibratory wet concrete screed comprising:

a blade for leveling wet concrete, the blade having a front edge and a rear edge; an exciter that is selectively driven to induce vibrations in the blade;

first and second operator-manipulated handles that are connected to the blade and that extends upwardly and rearwardly from the blade, each handle including a first end that is mounted on the blade, a second, free end, and a hand grip located between the first and second ends;

first and second mast mounted-receivers, each of which is mounted on the blade in the vicinity of a respective handle and which is located at a height above the second end of the respective handle; and first and second indicators, each of which is operatively connected to an associated receiver and which provides a visual indication of the screed height relative to a desired grade, wherein each indicator is mounted on the screed within 18" of the rear edge of the blade so as to permit a respective standing operator manipulating the associated handle to simultaneously view both the indicator and the rear edge of the blade;

wherein the exciter and blade are contained within a rectangular horizontal footprint bordered by outer edges of the exciter and the blade, and further comprising first and second adjustable mount assemblies, each of which supports a respective one of the handles and a respective one of the masts on the blade, each mount assembly being adjustable between a first, operative position in which at least one of the respective handle and the respective receiver are located at least in part outside of the footprint and a second, stowed position in which the respective handle and the respective receiver are located at least substantially entirely within the footprint.

11. The screed of claim 10, wherein the indicator includes a display that includes a plurality of lights that are illuminated in combinations that vary with the magnitude at which the screed is off-grade.

12. A portable vibratory wet screed comprising:

a blade for leveling wet concrete, the blade having a front edge and a rear edge; an exciter that is selectively driven to induce vibrations in the blade; and an operator-manipulated handle that is connected to the blade and that extends upwardly and rearwardly from the blade;

a mast that supports a laser receiver and that is mounted on the screed;

a mount assembly via which the handle and the mast are mounted on the blade, wherein the mount assembly includes a base and a pedestal that is mounted on the base so as to rotate about a vertical axis, and wherein the handle and the mast are each mounted on the pedestal so as to be pivotal about a horizontal axis;

wherein the handle and the mast are foldable, without removal from the blade, from an upright, operative position in which the handle extends vertically and horizontally well beyond horizontal and vertical footprints occupied by a combination of the blade and the exciter and the mast extends well above the vertical footprint of the blade and the exciter to a stowed position in which the handle and the mast are positioned at least substantially entirely within said horizontal and vertical footprints.

13. The screed of claim 12, further comprising an indicator that is operatively connected to the receiver and that provides a visual indication of screed height relative to a desired grade, wherein the indicator is located remote from the receiver at a location which, when viewed from the perspective of a person in the vicinity of a screed operator, is at least substantially in a focal area containing the rear edge of the blade.

14. The screed of claim 13, wherein the indicator includes a display that includes a plurality of lights that are illuminated in combinations that vary with the magnitude at which the screed is off-grade.

15. A method of operating a wet concrete screed having a blade and an operator's handle connected to the blade, the method comprising:

transmitting a laser beam from a transmitter located outside of a pour area to a receiver, the receiver being mounted on a mast which is supported on the blade, the mast and the handle being mounted on the blade via an adjustable mount, the adjustable mount including a base that is supported on the blade and a pedestal on which the mast and the handle are mounted, wherein the pedestal is mounted on the base so as to rotate about a vertical axis;

transmitting a signal from the receiver to an indicator supported on the screed remote from the receiver, wherein the indicator is positioned within 18 inches from a rear edge of the blade and an operator's eyes are offset upward and rearward from the indicator by a distance associated with an operator's arms and the handle;

in response to the transmitting step, displaying, on the indicator, a visual indication of the position of the screed relative to a desired grade;

manually manipulating the handle, using an operator's hands, while simultaneously viewing both the indicator and a rear edge of the blade;

and pivoting the handle and the receiver relative to the blade to fold the handle and the receiver from an upright, operative position in which the handle and the receiver extend well beyond at least one of a horizontal footprint and a vertical footprint occupied by the combination of the blade and the exciter, to a stowed position in which the handle and the receiver are positioned at least substantially entirely within said footprints.

16. The method of claim 15, wherein the displaying step comprises illuminating a plurality of lights in combinations that vary with the magnitude at which the screed is off-grade.

17. A portable vibratory wet concrete screed comprising:

a blade for leveling wet concrete, the blade having a front edge and a rear edge; an exciter that is selectively driven to induce vibrations in the blade;

at least one operator-manipulated handle that is connected to the blade and that extends upwardly and rearwardly from the blade;

a laser receiver that is mounted on the screed at a height above an upper end of the handle; and an indicator that is operatively connected to the receiver and that provides a visual indication of the screed height relative to a desired grade, wherein the indicator includes a display that visually indicates a change of magnitude at which the screed is off-grade without changing a frequency of indicator flashing; and wherein the indicator is located remote from the receiver at a location which, when viewed from the perspective of a person in the vicinity of a screed operator, is at least substantially at a focal distance and a sight direction that defines a focal area containing the rear edge of the blade such that an operator can simultaneously view both the indicator and the rear edge of the blade while standing and manipulating the handle;

wherein the handle and the receiver are mounted on the blade via an adjustable mount assembly, the mount assembly including a base that is supported on the blade and a pedestal that is mounted on the base so as to rotate about a vertical axis wherein the handle and the receiver are foldable from an upright, operative position in which they extend well beyond at least one of a horizontal footprint and a vertical footprint occupied by the combination of the blade and the exciter, to a stowed position in which the handle and the receiver are positioned at least substantially entirely within said footprints.

18. The screed of claim 17, wherein the display includes a plurality of lights that are illuminated in combinations that vary with the magnitude at which the screed is off-grade.

19. A portable vibratory wet concrete screed comprising:

a blade for leveling wet concrete, the blade having a front edge and a rear edge; an exciter that is selectively driven to induce vibrations in the blade;

at least one operator-manipulated handle that is connected to the blade and that extends upwardly and rearwardly from the blade;

a laser receiver that is mounted on the screed at a height above an upper end of the handle;

an indicator that is operatively connected to the receiver and that provides a visual indication of the screed height relative to a desired grade, wherein the indicator is located remote from the receiver at a location which, when viewed from the perspective of a person in the vicinity of a screed operator, is at least substantially in a focal area containing the rear edge of the blade;

wherein the handle and the receiver are mounted on the blade so as to be foldable from an upright, operative position in which they extend well beyond at least one of a horizontal footprint and a vertical footprint occupied by the combination of the blade and the exciter, and to a stowed position in which the handle and the receiver are positioned at least substantially entirely within said footprints;

an adjustable mount assembly via which the handle and the receiver are mounted on the blade, the mount assembly including a base that is supported on the blade and a pedestal that is mounted on the base so as to rotate about a vertical axis, the handle and the receiver each being supported on the pedestal of the mount assembly so as to pivot about a horizontal axis; and wherein the receiver is mounted on a mast that is pivotally mounted on a first side of the mounting portion of the mount assembly and the handle is pivotally mounted on a second side of the mount assembly.

* * * * *